US005436099A

United States Patent [19]

Schank et al.

[11] Patent Number: 5,436,099

[45] Date of Patent: Jul. 25, 1995

[54] PHOTORECEPTOR WITH LOW SURFACE ENERGY OVERCOAT

[75] Inventors: Richard L. Schank, Pittsford; James R. Esser, Rochester; Robert W. Hedrick, Spencerport, all of N.Y.

[73] Assignee: Xerox Corporation, Stamford, Conn.

[21] Appl. No.: 170,480

[22] Filed: Dec. 21, 1993

[51] Int. Cl.[6] ..... G03G 5/047; G03G 5/07

[52] U.S. Cl. ..... 430/59; 430/66; 430/96; 430/132

[58] Field of Search ..... 430/59, 66, 96, 132

[56] References Cited

U.S. PATENT DOCUMENTS

| | | | |
|---|---|---|---|
| 3,132,941 | 5/1964 | Stahly et al. | 430/96 |
| 4,275,133 | 6/1981 | Chu et al. | 430/96 |
| 4,371,600 | 2/1983 | Schank et al. | 430/66 |
| 4,871,634 | 10/1989 | Limburg et al. | 430/54 |
| 5,230,976 | 7/1993 | Schank et al. | 430/59 |
| 5,279,914 | 1/1994 | Aizawa et al. | 430/59 |
| 5,312,708 | 5/1994 | Terrell et al. | 430/59 |
| 5,342,719 | 8/1994 | Pai et al. | 430/59 |

FOREIGN PATENT DOCUMENTS 473292 3/1992 European Pat. Off. .

OTHER PUBLICATIONS

*Concise Encyclopedia of Polymer Science and Engineering*, J. Kroschwitz, John Wiley & Sons, N.Y., pp. 1048–1058 (1990).

*Primary Examiner*—Christopher D. Rodee

[57] ABSTRACT

An electrophotographic imaging member including a substrate, a charge generating layer, a charge transport layer, and an overcoat layer comprising a hole transporting hydroxy arylamine compound having at least two hydroxy functional groups, hydroxy terminated diorgano siloxane and a polyamide film forming binder capable of forming hydrogen bonds with the hydroxy functional groups of the hydroxy arylamine compound and the hydroxy terminated diorgano siloxane.

17 Claims, 4 Drawing Sheets

PHOTORECEPTOR WITH LOW SURFACE ENERGY OVERCOAT

BACKGROUND OF THE INVENTION

This invention relates in general to electrophotographic imaging members and, more specifically, to layered photoreceptor structures with low surface energy overcoatings and processes for making and using the photoreceptors.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

A latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example in U.S. Pat. No. 4,265,990. The disclosures of this patent is incorporated herein in its entirety. Other charge transport molecules disclosed in the prior art include a variety of electron donor, aromatic amines, oxadiazoles, oxazoles, hydrazones and stilbenes for hole transport and electron acceptor molecules for electron transport..Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilylenes, and others including those described, for example, in U.S. Pat. No. 4,618,551, 4,806,443, 4,806,444, 4,818,650, 4,935,487, and 4,956,440. The disclosures of these patents are incorporated herein in their entirety.

One of the design criteria for the selection of the photosensitive pigment for a charge generator layer and the charge transporting molecule for a transport layer is that, when light photons photogenerate holes in the pigment, the holes be efficiently injected into the charge transporting molecule in the transport layer. More specifically, the injection efficiency from the pigment to the transport layer should be high. A second design criterion is that the injected holes be transported across the charge transport layer in a short time; shorter than the time duration between the exposure an, d development stations in an imaging device. The transit time across the transport layer is determined by the charge carrier mobility in the transport layer. The charge carrier mobility is the velocity per unit field and has dimensions of cm2/volt sec. The charge carrier mobility is a function of the structure of the charge transporting molecule, the concentration of the charge transporting molecule in the transport layer and the electrically "inactive" binder polymer in which the charge transport molecule is dispersed. It is believed that the injection efficiency can be maximized by choosing a transport molecule whose ionization potential is lower than that of the pigment. However, low ionization potential molecules may have other deficiencies, one of which is their instability in an atmosphere of corona effluents. A copy quality defect resulting from the chemical interaction of the surface of the transport layer with corona effluents is referred to as "parking deletion" and is described in detail below.

Photoreceptors are cycled many thousands of times in automatic copiers, duplicators and printers. This cycling causes degradation of the imaging properties of photoreceptors, particularly multilayered organic photoconductors which utilize organic film forming polymers and small molecule low ionization donor material in the charge transport layers. Such wear is accelerated when the photoreceptor is utilized in systems employing abrasive cleaning subsystems such as cleaning blades. It has been found that in development systems such as single component development systems, early failure of cleaning blades is particularly acute where the drum is utilized has such a small diameter that it must rotate many, many times merely to form images for each conventional size 8.5 inch by 11 inch document. Early cleaning blade failure is especially evident at high temperature and humidity and leads to copier or printer down time and requires costly and time consuming replacement action for the cleaning blade, photoreceptor or an entire customer replaceable cartridge if the cleaning blade is an integral component of the cartridge.

Thus, although photoreceptors meet most electrophotographic criteria, they encounter serious cleaning blade failure problems when used in extended cycling runs, particularly at high temperature and humidity.

INFORMATION DISCLOSURE STATEMENT

U.S. Pat, No. 4,871,634 to Limburg et al., issued Oct. 3, 1989—An electrostatographic imaging member is disclosed which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

In copending application entitled "LAYERED PHOTORECEPTOR WITH OVERCOATINGS CONTAINING HYDROGEN BONDED MATERIALS", Ser. No. 08/172,520, filed concurrently herewith, an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. The entire disclosure of this copending application is incorporated herein by reference.

In copending application entitled "LONG LIFE PHOTORECEPTOR", Ser. No. 08/172,520, filed concurrently herewith, an electrophotographic imaging member is disclosed comprising a substrate, a charge generating layer, a charge transport layer, and an overcoat layer comprising a small molecule hole transporting triphenyl methane having at least one hydroxy functional group, and a polyamide film forming binder capable of forming hydrogen bonds with the hydroxy functional groups of the hydroxy triphenyl methane. This overcoat layer may be fabricated using an alcohol solvent. This electrophotographic imaging member may be utilized in an electrophotographic imaging process. The entire disclosure of this copending application is incorporated herein by reference.

Thus, there is a continuing need for photoreceptors that extends blade cleaning life.

SUMMARY OF THE INVENTION

It is, therefore, an object of the present invention to provide an improved electrophotographic imaging member which overcomes the above-noted deficiencies.

It is another object of the present invention to provide an improved electrophotographic imaging member exhibiting greater resistance to abrasion during image cycling.

It is yet another object of the present invention to provide an improved electrophotographic imaging member which extends blade cleaning life.

The foregoing objects and others are accomplished in accordance with this invention by providing an electrophotographic imaging member comprising a substrate, a charge generating layer, a charge transport layer, and an overcoat layer comprising a small molecule hole transporting arylamine having at least two hydroxy functional groups, a hydroxy terminated diorgano siloxane and a polyamide film forming binder capable of forming hydrogen bonds with the hydroxy functional groups on the hydroxy arylamine and hydroxy diorgano siloxane. This overcoat layer may be fabricated using an alcohol solvent. This electrophotographic imaging member may be utilized in an electrophotographic imaging process.

Figure 1:
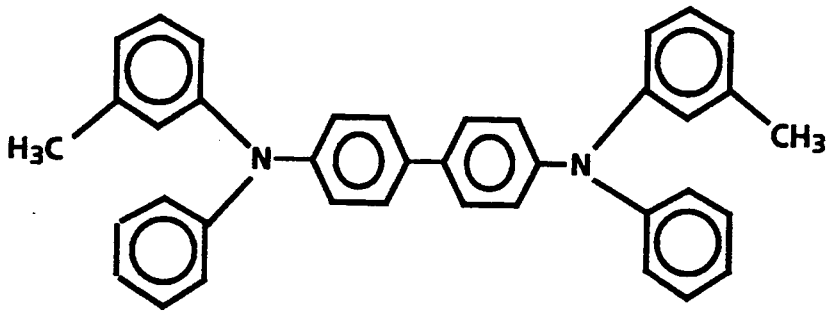
FIG. 1 illustrates a structural formula of an aromatic diamine molecule.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically nonconductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically ,conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Charge generator layers may comprise amorphous films of selenium and alloys of selenium and arsenic, tellurium, germanium and the like hydrogenated amorphous silicon and compounds of silicon and germanium, carbon, oxygen, nitrogen and the like fabricated by vacuum evaporation, or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers,, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also be fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4''-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine represented by the formula shown in FIG. 1.

Figure 2:
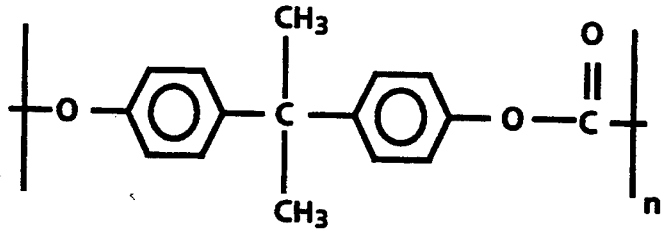
FIG. 2 illustrates a structural formula of a poly(4,4'-isopropylidene-diphenylene)carbonate.

The electrically inert polymeric binder generally used to disperse the electrically active molecule in the charge transport layer is a poly(4,4'-isopropylidene-diphenylene)carbonate (also referred to as bisphenol-A-polycarbonate) represented by the formula shown in FIG. 2.

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,00 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the, ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

If desired the electrophotographic imaging member of this invention may comprise a supporting substrate, a charge transport layer, charge generating layer and an overcoating layer instead of a supporting substrate, charge generating layer, a charge transport layer and an overcoating layer. Where the charge generating layer overlies the charge transport layer, the components of the charge generating layer should be insoluble in the alcohol solvent employed to apply the overcoat layer of this invention.

The overcoat layer of this invention comprises at least a polyamide film forming binder which is soluble in and coated from alcohol, a polyhydroxy arylamine charge transporting monomer, and a hydroxy terminated diorgano siloxane which greatly enhances cleaning blade life and may also eliminate the need for the pre-use application of a photoreceptor lubricant powder. All the components utilized in the overcoating of this invention should be soluble in a common alcohol solvent. When at least one component in the overcoating mixture is not soluble in the solvent utilized, phase separation can occur which would adversely affect the transparency of the overcoating and electrical performance of the final photoreceptor.

Any suitable alcohol soluble polyamide film forming binder capable for forming hydrogen bonds with hydroxy functional materials may be utilized in the overcoating of this invention. The expression "hydrogen bonding" is defined as an attractive force or bridge occurring between the polar hydroxy containing arylamine and a hydrogen bonding resin in which a hydrogen atom of the polar hydroxy arylamine is attracted to two unshared electrons of a resin containing polarizable groups. The hydrogen atom is the positive end of one polar molecule and forms a linkage with the electronegative end of the other polar molecule. The polyamide utilized in the overcoating of this invention should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of polyhydroxy arylamine charge transporting monomer minimizes these variations. The alcohol soluble polyamide should be capable of dissolving in an alcohol solvent which also dissolves the hole transporting small molecule having multiple hydroxy functional groups. The polyamide polymers of this invention are characterized by the the presence of the amide group —CONH. Typical polyamides include the various Elvamide resins which are nylon multipolymer resins, such as the alcohol soluble Elvamide arid Elvamide TH resins. Elvamide resins are available from E. I. DuPont Nemours and Company. Other examples of polyamides include Elvamide 8061, Elvamide 8064, Elvamide 8023.

When the overcoat layer contains only polyamide binder material, the layer tends to absorb moisture from the ambient atmosphere and become, s soft and hazy. This adversely affects the electrical properties, the cycling life, and sensitivity of the overcoated photoreceptor.

Figure 3A:
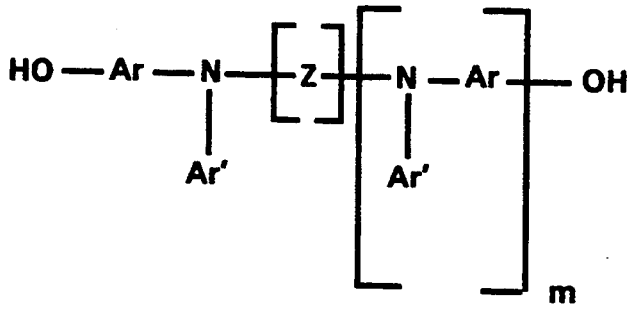
FIGS. 3*a* to 3*e* illustrate a generic structural formula of a small molecule hole transporting hydroxy arylamine.
Figure 3B:
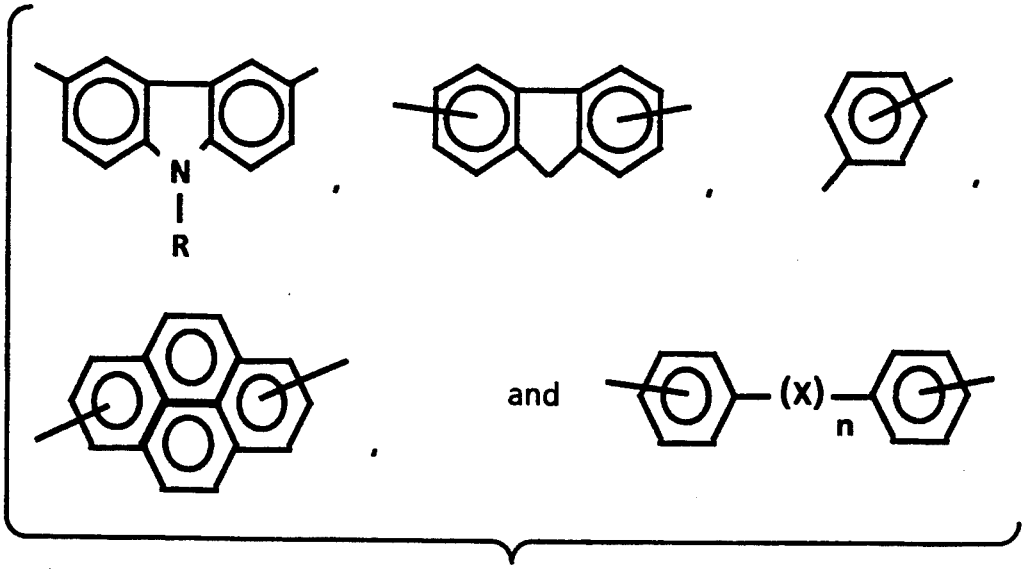
Figure 3C:
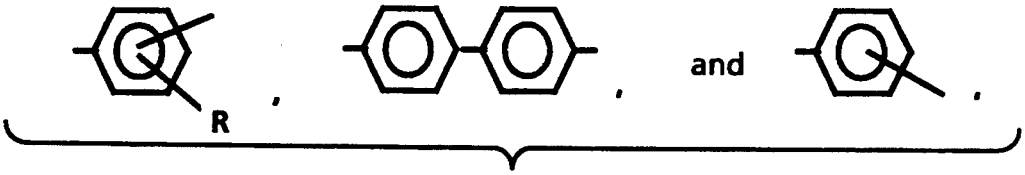
Figure 3D:
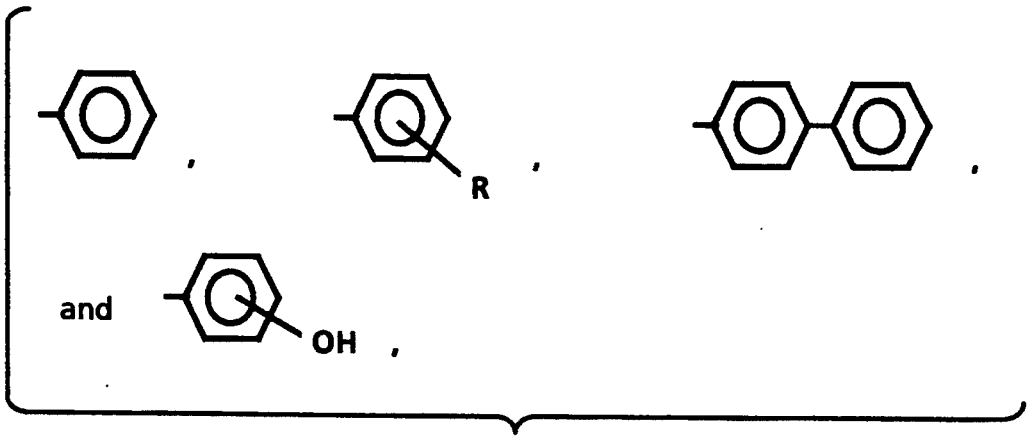
Figure 3E:
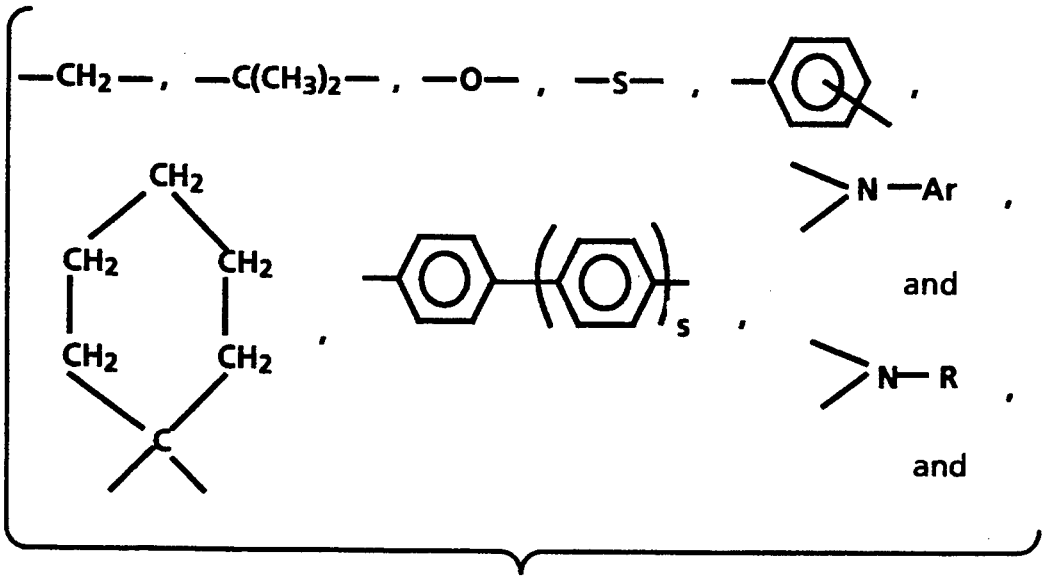

Any suitable polyhydroxy diaryl amine small molecule charge transport material having at least two hydroxy functional groups may be utilized in the overcoating layer of this invention. A preferred small molecule hole transporting material can be represented by the following formula shown in FIG. 3*a*,
wherein:

m is 0 or 1,

Z is selected from the group consisting of the groups shown in FIG. 3*b*, n is 0 or 1, Ar is selected from the group consisting of the groups shown in FIG. 3*c*, R is selected from the group consisting of —$CH_3$, —$C_2H_5$, —$C_3H_7$, and —$C_4H_9$, Ar′ is selected from the group consisting of the groups shown in FIG. 3*d*, X is selected from the group consisting of the groups shown in FIG. 3*e*, s is 0, 1 or 2, the dihydroxy arylamine compound being free of any direct conjugation between the —OH groups and the nearest nitrogen atom through one or more aromatic rings.

Figure 4:
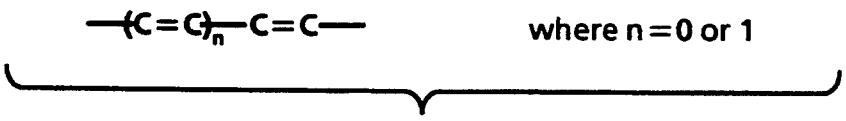
FIG. 4 illustrates structural formula of a direct conjugation segment.

The expression "direct conjugation" is defined as the presence of a segment having the formula shown in FIG. 4 in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Figure 5:
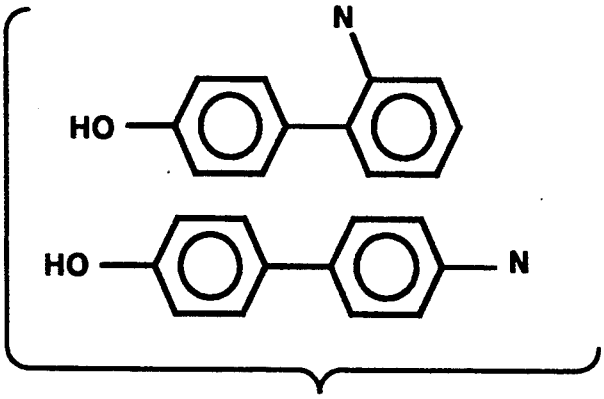
FIG. 5 illustrates structural formulae of compounds in which hydroxyl groups are in direct conjugation with nitrogen through a phenylene ring system.

The two structures shown in FIG. 5 are illustrative examples of specific compounds in which the hydroxyl group is in direct conjugation with the nitrogen through a phenylene ring system.

Typical polyhydroxy arylamine compounds utilized in the overcoat of this invention include, for example:

N,N′-diphenyl-N,N′-bis(3-hydroxyphenyl)-[1,1′-biphenyl]-4,4′-diamine;

N,N,N′,N′,-tetra(3-hydroxyphenyl)-[1,1′-biphenyl]-4,4′-diamine;

N,N-di(3-hydroxyphenyl)-m-toluidine;

1,1-bis-[4-(di-N,N-m-hydroxpyphenyl)-aminophenyl]-cyclohexane;

1,1-bis[4-(N-m-hydroxyphenyl)-4-(N-phenyl)-aminophenyl]-cyclohexane;

Bis-(N-(3-hydroxyphenyl)-N-phenyl-4-aminophenyl)-methane;

Bis[(N-(3-hydroxyphenyl)-N-phenyl)-4-aminophenyl]-isopropylidene;

N,N′-diphenyl-N,N′-bis(3-hydroxyphenyl)-[1,1′:4′,1″-terphenyl]-4,4″-diamine;

9-ethyl-3.6-bis[N-phenyl-N-3(3-hydroxyphenyl)-amino]-carbazole;

2,7-bis[N,N-di(3-hydroxyphenyl)-amino]-fluorene;

1,6-bis[N,N-di(3-hydroxyphenyl)-amino]-pyrene;

1,4-bis[N-phenyl-N-(3-hydroxyphenyl)]-phenylenediamine.

Figure 6:
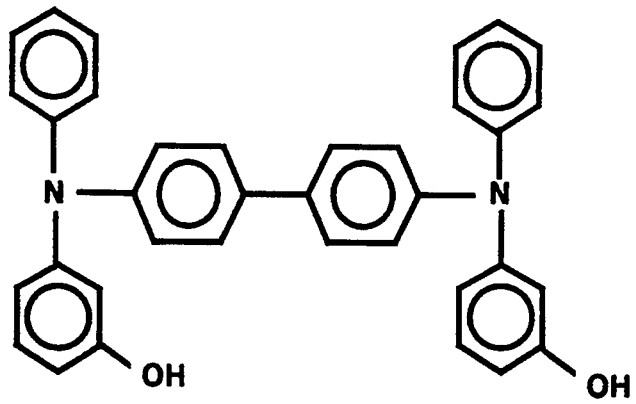
FIGS. 6 and 7 illustrate structural formulae of hydroxy arylamine compounds.
Figure 7:
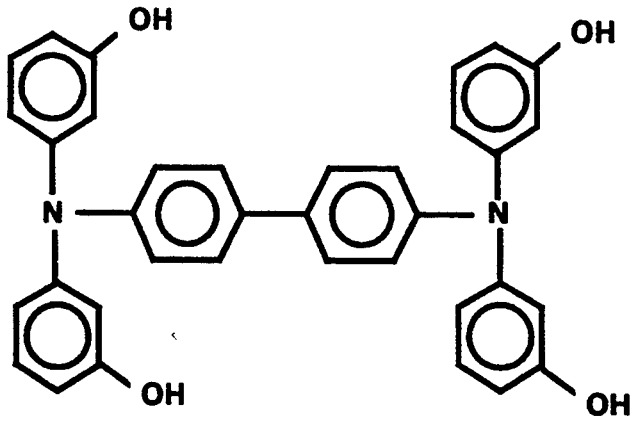

Structural formulae for some of these polyhydroxy arylamine compounds are illustrated in FIGS. 6 and 7.

Typical hydroxy arylamine compounds containing direct conjugation between the —OH groups and the nearest nitrogen atom through one or more aromatic rings include, for example:

N,N′-diphenyl-N-N′-bis(4-hydroxy phenyl)[1,1′-biphenyl]-4,4′-diamine

N,N,N′,N′,-tetra(4-hydroxyphenyl)-[1,1′-biphenyl]-4,4′-diamine;

N,N-di(4-hydroxyphenyl)-m-toluidine;

1,1-bis-[4-(di-N,N-p-hydroxpyphenyl)-aminophenyl]-cyclohexane;

1,1-bis[4-(N-o-hydroxyphenyl)-4-(N-phenyl)-aminophenyl]-cyclohexane;

Bis-(N-(4-hydroxyphenyl)-N-phenyl-4-aminophenyl)-methane;

Bis[(N-(4-hydroxyphenyl)-N-phenyl)-4-aminophenyl]-isopropylidene;

Bis-N,N-[(4′-hydroxy-4-(1,1′-biphenyl)]-aniline;

Bis-N,N-[(2′-hydroxy-4-(1,1′-biphenyl)]-aniline and the like.

Charge transporting polyhydroxy arylamine compound are known and are described, for example in U.S. Pat. No. 4,871,634, the entire disclosure thereof being incorporated herein by reference.

The charge transporting small molecule may transport positive charges or negative charges. Other typical electron transporting small molecules having at least two hydroxy functional groups include, for example, hydroxy functionalized BCFM, pyrazolines, and the like.

The overcoating layer of this invention also contains at least one hydroxy terminated diorgano siloxane. The hydroxy terminated diorgano siloxane should contain at least one hydroxy functional group and, more preferably, two hydroxy functional groups. The hydroxyl groups of the diorgano siloxane molecules are very strongly attracted to polyamide binders capable of forming hydrogen bonds. Additionally, these hydroxy terminated diorgano siloxane molecules are soluble in alcohol which must also be used as the solvent for the polyamide binder and hydroxy arylamines. The presence of hydroxy terminated diorgano siloxanes in the overcoat greatly increases cleaning blade and photoreceptor life. Unlike ordinary alkyl or phenyl group terminated diorgano siloxanes, the hydroxy terminated ,diorgano siloxane molecules in the overcoat of this invention, because of the presence of the hydroxyl groups, can hydrogen bond to the polyamide binder to form a stable solution.

Figure 8:
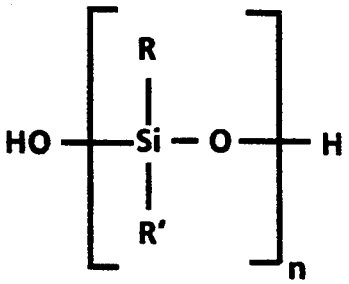
FIG. 8 illustrates a generic structural formula for hydroxy diorgano siloxane.

Hydroxy terminated diorgano siloxane molecules of this invention are represented by the generic formula shown in FIG. 8 wherein R and R′ are organo groups independently selected from the group consisting of an alkyl group and an aromatic group and n is a number between about 3 and about 8. Thus, for example, both the organo groups R and R′ may each be a methyl group, R may be a methyl group and R′ a phenyl group, or R may be are ethyl group and R′ a methyl group. The hydroxy terminated dimethyl siloxane utilized in the overcoat layer of this invention is a fluid and the preferred dimethyl siloxane preferably has a weight average molecular weight between about 240 and about 642. The hydroxy terminated diorgano siloxane should dissolve in the alcohol employed to dissolve the polyamide binder and the hydroxy arylamine.

Any suitable alcohol may be employed to apply the overcoating composition of this invention. The alcohol selected should dissolve the polyhydroxy arylamine, the hydroxy terminated diorgano siloxane, and the polyamide utilized in the overcoating layer. The alcohol solvent should not dissolve any binder in the underlying layer. The use of an alcohol solvent minimizes the impact of the coating process on the environment. The alcohol should contain at least one hydroxy functional group per molecule. Typical alcohols include, for example, methanol, ethanol, isopropanol, and the like. Satisfactory results may be achieved when the amount of alcohol utilized is between about 99 percent by weight and about 70 percent by weight based on the total weight of the coating composition. Generally, the optimum amount of alcohol utilized depends upon the particular type of coating process utilized to apply the overcoating material.

The concentration of the polyhydroxy arylamine charge transporting molecules in the overcoat can be between 85 and about 5 percent by weight based on the total weight of the dried overcoat. When the proportion of polyhydroxy arylamine small molecule hole transporting molecule in the overcoating is less than about 5 percent by weight, the hole transport mobility of the overcoat layer may not be as efficient as desired or as needed. When the proportion of poly hydroxy arylamine small molecule charge transport material in the overcoating layer exceeds about 90 percent by weight based on the total weight of the overcoating layer, crystallization may occur resulting in residual cycle-up. Also, the physical properties of the polyamide film could be adversely affected. The concentration of the hydroxy terminated diorgano siloxane in the overcoat layer is between about 0.1 percent and about 10 percent by weight based on the total weight of the dried overcoat. When less than about 0.1 percent by weight of hydroxy terminated diorgano siloxane is present in the overcoat, the beneficial results of improved cleaning blade life is less pronounced. When the proportion of hydroxy terminated diorgano siloxane in the overcoating layer is greater than about 10 percent by weight based on the total weight of the overcoating layer, incompatability of the siloxane fluid may be observed. The total combined concentration of the hydroxy aryl amine and hydroxy terminated diorgano siloxane should be between about 5 percent and about 50 percent by weight based on the total weight of the dried overcoat, the remainder normally being the polyamide binder.

Any suitable coating technique may be utilized to form the overcoating layer. Typical coating techniques include spraying, extrusion coating, rotll coating, veneer coating, dip coating, slide coating, slot coating, wife wound rod coating, and the like.

Any suitable technique may be utilized to dry the overcoating. Typical drying techniques include oven drying, forced air oven drying, radiant heat drying, and the like.

The thickness of the dried overcoat layer should be uniform and continuous. It can range in thickness from a mono molecular thickness up to a maximum thickness about about 10 micrometers. Generally, thicker coatings may be utilized for slower electrophotographic copier and printers.

If desired, the outer surface of the overcoating layer may be imparted with a texture to minimize the formation of moray patterns. The texture may be achieved by any suitable means such as embossing, regulation of drying conditions, and the like.

Generally, when large amounts of a charge transporting molecule material is added to an overcoating layer, the strength of the overcoating layer is reduced. Surprisingly, the overcoating layer of this invention becomes tougher when large amounts of small molecule arylamine material having at least two hydroxy functional groups are incorporated into the overcoating layer of this invention. When arylamine charge transport material having at least two hydroxy functional groups and hydroxy terminated diorgano siloxane are blended with polyamide binder capable of hydrogen bonding to achieve hydrogen bonding, the combination of materials restricts the absorption of atmospheric moisture into the polyamide polymer even at high temperatures thereby eliminating the plasticizing effect of the water. Moisture tends to lessen overcoating abrasion an, d wear resistance when the overcoating contains only the polyamide.

Figure 9:
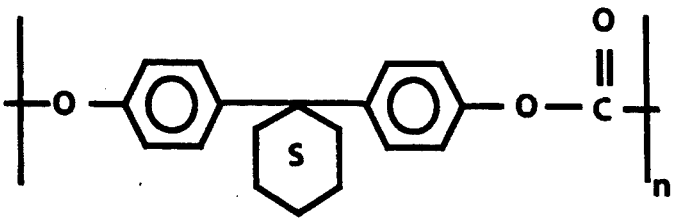
FIG. 9 illustrates a structural formula for poly(4,4'-cyclohexylidine-diphenylene)carbonate.

The film forming binder for the transport layer should not dissolve in the alcohol solvent selected for the overcoating layer. For example, charge transport layer binders such as polycarbonates such as do not dissolve in alcohol. Thus, for example, poly(4,4'-isopropylidenediphenylene) carbonate (i.e. bisphenol-A-polycarbonate) or poly(4,4'-cyclohexylidine-diphenylene) carbonate (also referred to as bisphenol-Z-polycarbonate), having a structure represented by the formula shown in FIG. 9, do not dissolve in alcohols such as methanol, ethanol, isopropanol, and the like. Bisphenol-A-polycarbonate dissolves in methylene chloride and bisphenol-Z-polycarbonate is soluble in toluene. Other polymers insoluble in alcohols include, for example, polyesters, polystyrenes, and the like. The expression "soluble" as employed herein is defined as capable of forming a solution with which a film can be applied to a surface and dried to form a continuous coating. The expression "insoluble" as employed herein is defined as not capable of forming a solution so that the solvent and the solid remain in two separate phases and a continuous coating cannot be formed. Molecular weights of the polymers can vary, for example, from about 20,000 to about 150,000.

The composition and materials employed in the overcoat layer must meet several requirements: (1) it should be charge transporting to prevent a residual build up across the overcoat, and (2) it should not intermix into the charge transport layer during the process of fabricating the overcoat. The second requirement can be met by the judicious selection of binders for the charge transport layer and the overcoat layers whereby the polymer binder for the overcoat is soluble in a solvent in which the polymer binder for the charge transport layer is insoluble. other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The photoreceptor of this invention may be used in any conventional electrophotographic imaging system. As described above, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once. Cleaning of photoreceptors with devices such as cleaning blades is well known in the art. Cleaning blades usually comprise a resilient material such polyurethane, rubber, polytetrafluorethylene, and the like. These blades are conventionally brought into contact with the imaging surface of the photoreceptor with a scraping or "doctor" action to remove the residual toner particles.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

TEST PROCEDURE UTILIZED IN FOLLOWING EXAMPLES

A turntable device was fitted with a polyurethane blade configured in the doctor mode, the blade was adjustable for reproducible setting of the nip gap, a metered dispenser was used to feed specific quantities of abrading agent at predetermined intervals onto a rotating sample platen, and a tachometer and timer were used to calculate the number of elapsed sample rotations. This device was employed to test wear of materials by abrasion. Wear was calculated in terms of nanometers/kilocycles of rotation (nm/Kc). Reproducibility of calibration standards was without ±/nm/Kc. Sample wear was measured by an interference measuring device, known as an Otsuka gauge.

EXAMPLE I

A photoreceptor was prepared by forming coatings using conventional techniques on an aluminum drum, having a length of 288 millimeters and a diameter of 84 millimeters. The first deposited coating was a thin barrier layer formed from 3-aminopropyl triethoxy silane and monoacetyl acetonate zirconium tributoxide. The next coating was a charge generator layer containing 88 percent by weight dibromoanthanthrone particles dispersed in polyvinylbutyral having a thickness of 1.1 micrometer. The next layer was a transport layer containing 36 percent by weight N,N'-diphenyl-N,N'-bis(3-methyl-phenyl)-(1,1'biphenyl)-4,4'-diamine and 64 percent by weight poly(4,4'-cyclohexylidine-diphenylene)-carbonate resin. The N,N'-diphenyl-N,N'-bis(3-methylphenyl)-(1,1'biphenyl)-4,4'-diamine is an electrically active aromatic diamine charge transport small molecule whereas the polycarbonate resin is an electrically inactive film forming binder. The photoreceptor drum was dip coated with an overcoat solution of 25.0 grams of 10 percent by weight polyamide (Elvamide 8061, available from dupont de Nemours & Co.) in a 90/10 by weight isopropanol/water mixture, 2.5 grams N,N'-diphenyl-N,N'-bis(3-hydroxyphenyl)-[1,1'-biphenyl]-4,4'-diamine (a dihydroxy arylamine), 2.5 grams of 0.1 weight percent Elvacite 2008 in 90/10 by weight isopropanol/water (adhesion promoter), and 0.3 grams of 10 weight percent hydroxy terminated dimethyl siloxane fluid (PSX 464, available from Petrarch Inc.) in propanol. The drum was withdrawn from the overcoat solution at a pull rate of 150 millimeters per minute. The applied coating was then dried in an oven at 125° C. for 1 hour to form a 2.8 micrometer thick overcoat layer. The photoreceptor was then tested in a Xerox 5012 xerographic copying machine fitted with a 288 mm long, 2 mm thick polyurethane cleaning blade positioned in contact with the overcoating in a scraping (doctor) attitude. Xerographic copies made with the overcoated photoreceptor showed no observable change during image cycling for 24 hours at 27° C. (80° F.) and 80 percent RH. After storage in the machine for 1.5 weeks at 27° C. (80° F.) and 80 percent RH, the photoreceptor formed images on xerographic copies as well as it did in the 24 hour imaging test. Examination of the cleaning blade after 20,000 imaging cycles revealed no blade wear. The use of the overcoating of this invention allows photoreceptor drums to be installed into a xerographic imaging machine without the use of topically applied polyvinylidene fluoride (Kynar) powder to the cleaning blade or to the photoreceptor prior to machine operation. If this were attempted on a photoreceptor drum without this overcoating, the cleaning blade would typically tear or flip over, in either case catastrophically failing.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a charge generating layer, a charge transport layer comprising charge transporting molecules dispersed in an alcohol insoluble polymer binder, and an overcoat layer overlying said charge transport layer, said overcoat layer comprising a hole transporting hydroxy arylamine compound having at least two hydroxy functional groups, hydroxy terminated diorgano siloxane represented by the formula:

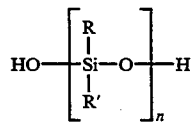

wherein R and R' are organo groups independently selected from the group consisting of an alkyl group and an aromatic group and n is a number between about 3 and about 8, and a polyamide film forming binder capable of forming hydrogen bonds with said hydroxy functional groups of said hydroxy arylamine compound and said hydroxy terminated diorgano siloxane.

2. An electrophotographic imaging member according to claim 1 wherein said hole transporting hydroxy arylamine compound is represented by the formula:

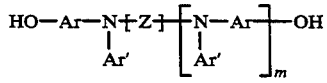

wherein:

m is 0 or 1,

Z is selected from the group consisting of:

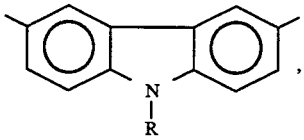

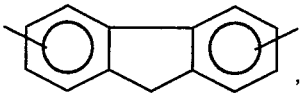

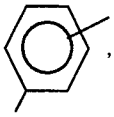

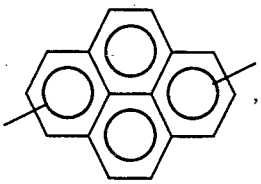

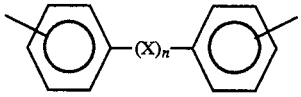

n is 0 or 1,

Ar is selected from the group consisting of:

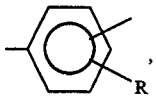

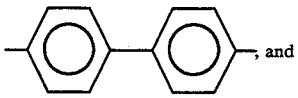

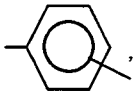

R is selected from the group consisting of $—CH_3$, $—C_2H_5$, $—C_3H_7$, and $—C_4H_9$, Ar′ is selected from the group consisting of:

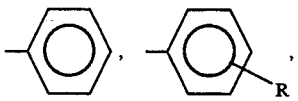

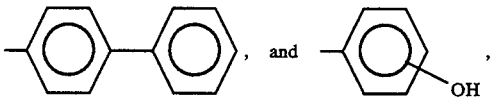

X is selected from the group consisting of:

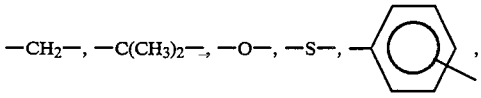

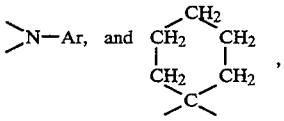

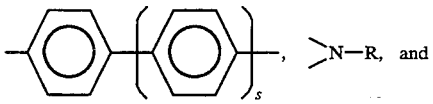

s is 0, 1 or 2, said hydroxy arylamine compound being free of any direct conjugation between the —OH groups and the nearest nitrogen atom through one or more aromatic rings.

3. An electrophotographic imaging member according to claim 1 wherein said polyamide film forming binder contains —CONH groups capable of forming hydrogen bonds with said hydroxy functional groups of said hydroxy arylamine compound and said hydroxy terminated diorgano siloxane.

4. An electrophotographic imaging member according to claim 1 wherein the concentration of said hydroxy arylamine compound in said overcoat layer is between about 20 percent and about 80 percent by weight based on the total weight of said overcoat after drying.

5. An electrophotographic imaging member according to claim 1 wherein the concentration of said hydroxy terminated diorgano siloxane in said overcoat layer is between about 0.1 percent and about 10 percent by weight based on the total weight of said overcoat after drying.

6. An electrophotographic imaging member according to claim 1 wherein the concentration of said polyamide in said overcoat layer is between about 80 percent and about 20 percent by weight based on the total weight of said overcoat after drying.

7. An electrophotographic imaging member according to claim 1 wherein said hydroxy arylamine compound is N,N′-diphenyl-N,N′-bis(3-hydroxyphenyl)-[1,1′-biphenyl]-4,4′-diamine.

8. An electrophotographic imaging member according to claim 1 wherein said hydroxy arylamine compound is N,N,N′,N′,-tetra(3-hydroxyphenyl)-[1,1′-biphenyl]-4,4′-diamine.

9. An electrophotographic imaging member according to claim 1 wherein said hydroxy terminated diorgano siloxane is a liquid having a weight average molecular weight between about 240 and about 642.

10. An electrophotographic imaging member according to claim 1 wherein said charge transport layer is between said substrate and said charge generation layer.

11. An electrophotographic imaging member according to claim 10 wherein said charge transport layer comprises electrically active charge transporting molecules dissolved or molecularly dispersed in an electrically inactive polymer binder which is insoluble in alcohol.

12. An electrophotographic imaging member according to claim 1 wherein said charge transport layer is substantially free of said hydroxy terminated diorgano siloxane.

13. An electrophotographic imaging member according to claim 1 wherein said charge generation layer is between said substrate and said charge transport layer.

14. An electrophotographic imaging member according to claim 1 wherein said overcoat layer is a continuous layer having a thickness up to about about 10 micrometers.

15. An electrophotographic imaging member according to claim 1 wherein said charge transport layer has a thickness of between about 5 micrometers and about 50 micrometers.

16. An electrophotographic imaging member according to claim 1 wherein said diorgano siloxane is dimethyl siloxane.

17. A process for fabricating an electrophotographic imaging member comprising providing a substrate coated with a charge generating layer and a charge transport layer comprising charge transporting molecules dissolved or molecularly dispersed in an alcohol insoluble polymer binder, forming on said charge transport layer a coating of a solution comprising a hydroxy arylamine compound having at least two hydroxy functional groups, hydroxy terminated diorgano siloxane represented by the formula:

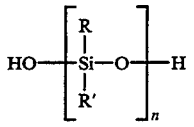

wherein R and R′ are organo groups independently selected from the group consisting of an alkyl group and an aromatic group and n is a number between about 3 and about 8, and a polyamide film forming binder capable of forming hydrogen bonds with said hydroxy functional groups of said hydroxy arylamine compound and said hydroxy terminated diorgano siloxane dissolved in an alcohol solvent, and drying said coating to remove said alcohol solvent to form a substantially dry overcoat layer.

* * * * *